US010292437B2

(12) United States Patent
Marji

(10) Patent No.: US 10,292,437 B2
(45) Date of Patent: May 21, 2019

(54) MEN'S BRIEF HAVING PENILE POUCH SECURELY ADJUSTABLE AT DIFFERENT POSITIONS

(71) Applicant: Sammy Black Marji, Yonkers, NY (US)

(72) Inventor: Sammy Black Marji, Yonkers, NY (US)

( * ) Notice: Subject to any disclaimer, the term of this patent is extended or adjusted under 35 U.S.C. 154(b) by 262 days.

(21) Appl. No.: 14/984,106

(22) Filed: Dec. 30, 2015

(65) Prior Publication Data

US 2017/0188637 A1 Jul. 6, 2017

(51) Int. Cl.
*A41B 9/12* (2006.01)
*A41B 9/02* (2006.01)
*A41B 9/14* (2006.01)

(52) U.S. Cl.
CPC ..... *A41B 9/12* (2013.01); *A41B 9/023* (2013.01); *A41B 9/14* (2013.01)

(58) Field of Classification Search
CPC .. A41B 9/00; A41B 9/02; A41B 9/023; A41B 9/026; A41B 9/12; A41B 9/14; A41B 9/001; A41B 9/004; A41B 9/005; A41B 9/007
USPC ..... 2/403, 408
See application file for complete search history.

(56) References Cited

U.S. PATENT DOCUMENTS 642,920 A * 2/1900 Sittig ..... A61F 5/40 2/403
1,339,070 A * 5/1920 Sanders ..... A61F 5/40 2/403
1,615,192 A * 1/1927 Pelton ..... A61F 5/40 2/403
1,992,351 A * 2/1935 Burnell ..... A41B 9/023 2/403
2,058,970 A * 10/1936 Flesh ..... A41B 9/02 2/403
2,872,685 A * 2/1959 Denbo ..... A41B 9/02 2/403
3,207,155 A * 9/1965 Casey ..... A41B 9/02 2/403
3,279,469 A * 10/1966 Schustack ..... A41C 1/003 2/408
3,517,666 A * 6/1970 Atlee ..... A41B 9/02 2/403
4,471,772 A * 9/1984 Miller, Jr. ..... A61F 5/41 2/403
4,526,167 A * 7/1985 Ebenal ..... A41B 9/023 2/403
4,622,962 A * 11/1986 Kauffman ..... A61F 5/40 602/70
5,290,270 A * 3/1994 Fisher ..... A41B 9/02 2/403

(Continued)

FOREIGN PATENT DOCUMENTS

NL 1007896 C2 * 6/1999 ..... A41B 9/02

*Primary Examiner* — Alissa L Hoey

(57) ABSTRACT

A men's brief is provided which protects penile impact experienced by athletes during exercise and sport activities. The brief is made from cotton or similar fabric and has a penile pouch for accommodating the penis and an opening through which the pouch can protrude. A male fastener is provided on the outer tip of the pouch which can be fastened to one or more female fasteners provided near the waistband of the brief.

1 Claim, 3 Drawing Sheets

(56) References Cited

U.S. PATENT DOCUMENTS 5,984,910 A * 11/1999 Berke ..... A41B 9/023 128/854
6,295,651 B1 * 10/2001 Kang ..... A41B 9/02 2/400
6,406,462 B1 * 6/2002 Johnson ..... A61F 5/453 2/403
6,901,607 B1 * 6/2005 Elwell ..... A41B 9/023 2/400
7,032,249 B2 * 4/2006 Smith ..... A41B 9/001 2/404
7,100,213 B2 * 9/2006 Krautbauer ..... A41B 9/001 2/400
7,434,273 B2 * 10/2008 Chung ..... A41B 9/023 2/403
7,578,009 B1 * 8/2009 Boston ..... A41B 9/023 2/238
9,173,434 B2 * 11/2015 Yoo ..... A41B 9/02
9,375,035 B1 * 6/2016 Ingels ..... A41B 9/02
9,713,348 B2 * 7/2017 Astin ..... A41B 9/026
9,987,173 B1 * 6/2018 Montgomery ..... A61F 13/4915
2004/0231034 A1 * 11/2004 Cym ..... A41B 9/023 2/403
2005/0131361 A1 * 6/2005 Miskie ..... A61F 5/4404 604/350
2007/0038193 A1 * 2/2007 Miskie ..... A61F 5/453 604/349
2007/0277285 A1 * 12/2007 Gravette ..... A41B 9/023 2/78.1
2009/0318754 A1 * 12/2009 Ettmer ..... A61F 5/41 600/38
2010/0077535 A1 * 4/2010 Kimberly ..... A41B 9/001 2/400
2012/0260404 A1 * 10/2012 Steele ..... A41B 9/023 2/404
2013/0104294 A1 * 5/2013 Edwards ..... A41B 9/04 2/408
2013/0174328 A1 * 7/2013 Rolon ..... A41B 9/023 2/403
2014/0059744 A1 * 3/2014 Lin ..... A41B 9/023 2/403
2015/0047107 A1 * 2/2015 Crissman ..... A41B 9/023 2/403
2015/0082519 A1 * 3/2015 Yoo ..... A41B 9/023 2/403
2016/0120231 A1 * 5/2016 Deluca ..... A41B 9/023 2/403
2017/0135875 A1 * 5/2017 Johnson ..... A41B 9/02

* cited by examiner

MEN'S BRIEF HAVING PENILE POUCH SECURELY ADJUSTABLE AT DIFFERENT POSITIONS

FIELD OF THE INVENTION

The present invention relates to men's briefs or underpants and is particularly related to men's brief having a penile pouch which can be secured at different positions outside the waistband of the brief.

BACKGROUND OF THE INVENTION

There are numerous patents and publications relating to various types and designs of men's underwear, some having to do with their style while others are directed to their comfort and protective features, especially when worn during sport exercises. As discussed in U.S. Pat. No. 6,863,746 B2 issued Mar. 8, 2005, men's underpants are mainly divided into two types, "triangular" underpants and "rectangular" underpants and they are usually made of cotton or some other suitable fabric. A port formed in the front of the underpants permits pulling the penis out of the underpants during urination.

Another patent, i.e., U.S. Pat. No. 7,017,193 B2 issued Mar. 26, 2006 discloses that the male genitals require special protection during rough activities which are experienced in various exercises and sports. This patent recognizes the need for improved type of men's brief which provides the genitals to be neatly tucked away by providing a special pocket for the genitals and special stitches as shown in FIGS. 1 and 3 of the patent.

A more recent patent, i.e. U.S. Pat. No. 8,230,526 B2 issued Jul. 31, 2012, describes a men's underwear for supporting the male genitals, the underwear being formed of a double layered front portion having an inner layer and an outer layer, wherein a lower portion of the inner layer of the doubled layer front portion is folded upward to form a pouch or the interior of the garment such that in use the pouch engages with the genitals and displaces the genitals forward and/or upward.

Notwithstanding the numerous prior art patents and publications relating to men's briefs, there is still a dire need for a men's brief which can provide penile stability and less impact during various sports and exercises which normally causes penile impact and discomfort.

It is therefore an object of the present invention to provide a men's brief or underpants which are designed to overcome the discomfort normally experienced wearing underpants during various exercises and sports activities.

It is a further object of the present invention to provide a men's brief designed to provide the brief with a pouch for accommodating the penis and having a waistband provided with several spaced apart securing means for securing the penile pouch to each of said securing means as desired.

The foregoing and other objects of the invention will be more clearly understood from the following detailed description of the invention and accompanying drawings.

SUMMARY OF THE INVENTION

The present invention discloses a men's brief designed to protect against undesirable penile impact experienced by many athletes during various sports activities and exercise. The brief described herein may be made from cotton or fabric normally used for making briefs and underpants. The brief has a waistband and tubular pocket member in the middle of the brief which is usually made from the same material as the brief, and may be stretchable to accommodate different penile sizes. An opening is provided in the middle of the brief through which the tubular member protrudes. The outer tip of the tubular pocket has a male fastener affixed thereto near the waistband, the brief is provided with spaced apart female fasteners. In order to avoid undesirable or uncomfortable impacts by the penis during exercise or sport activity, the tubular pocket containing the penis can be lifted upward and fixed in one position by snapping the male fastener on the outer top of the tubular pocket into any one of the female fasteners adjacent the waistband of the brief.

BRIEF DESCRIPTION OF THE DRAWINGS

In the drawings wherein like reference numerals designate like parts.

DETAILED DESCRIPTION OF THE INVENTION

Figure 1:
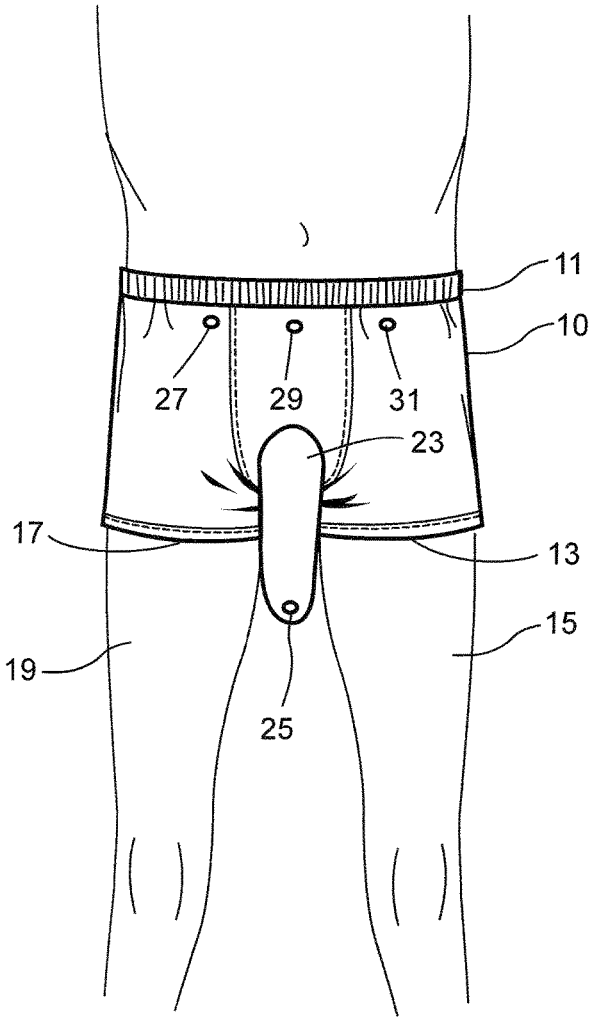
FIG. 1 illustrates a schematic front view of a men's brief having a penile pouch for accommodating the penis when protruded from the brief, and wherein the brief is provided with spaced apart female fasteners which can be engaged into male fasteners provided externally at the tip of the penile pouch.
Figure 2:
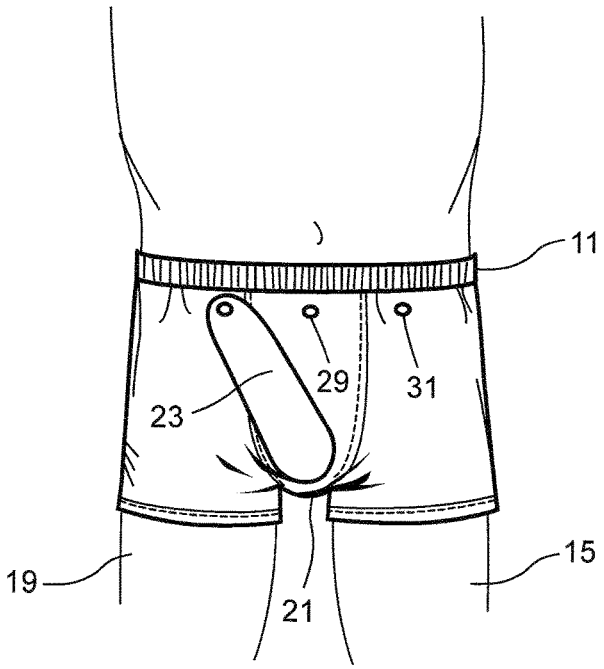
FIG. 2 is a schematic front view of the brief shown in FIG. 1 wherein the penile pouch is lifted upward and is securely positioned by engaging the male fastener of the penile pouch to the female fastener on one side of the brief.
Figure 3:
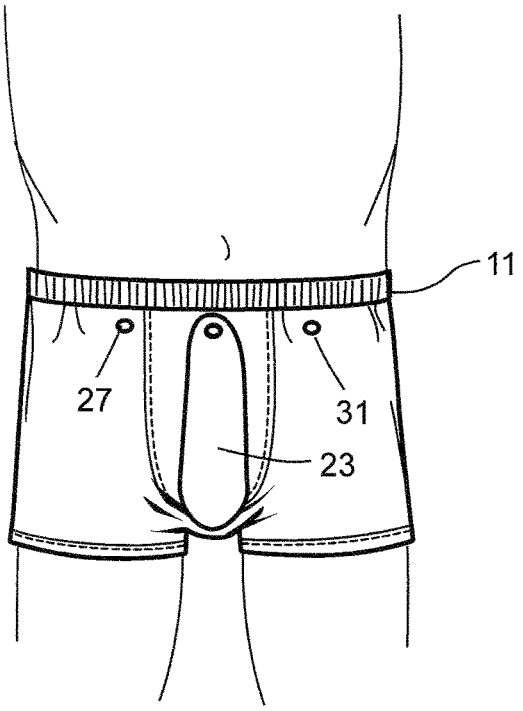
FIG. 3 is a schematic view similar to FIG. 2 but wherein the penile pouch is lifted upward and secured to a female fastener at the middle of the brief.
Figure 4:
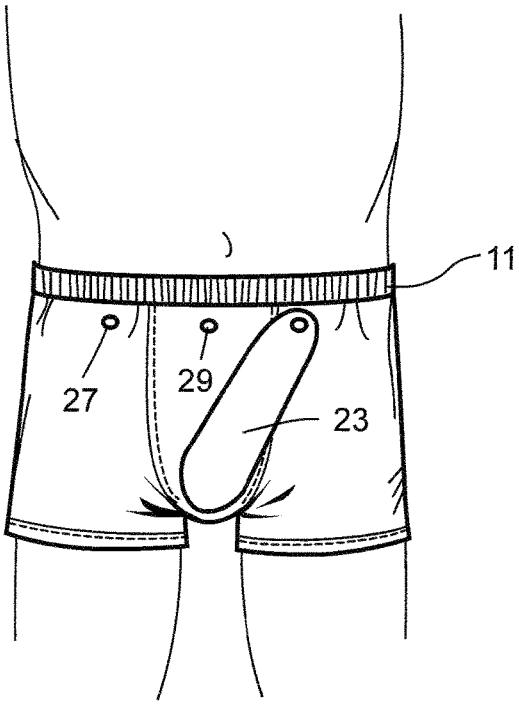
FIG. 4 is a view similar to FIGS. 2 and 3 but wherein the penile pouch is fastened at the other side of the brief.

Referring to the drawings, there is shown in FIG. 1 a men's brief generally designated by the reference number 10 having a waistband 11 which may be provided with an elastic band in order to adjust the brief around the waist. The brief has a left opening 13 for inserting the left leg 15 of the wearer, and a right opening 17 for inserting the right leg 19 of the wearer. An opening 21 is formed into the middle of the brief through which tubular pocket 23 protrudes from the brief while the penis can be retained in said tubular pocket 23. A male fastener 25 is affixed at the outer tip of the tubular pocket 23 which can be fastened to any of the spaced apart female fasteners 27, 29, 31 attached outside the brief adjacent to the waistline as shown in FIGS. 3 and 4.

When a person is engaged in certain sport activities, there is a tendency for the penis to impact on the genitals or internal part of the brief which can cause discomfort to the exerciser. The present brief permits the exerciser to prevent such impact by lifting the tubular pocket 23 upward and affixing the male fastener 25 to any of the female fasteners 27, 29, or 31 thus firmly fixing the position of the penis in order to avoid injury during exercise.

Figure 5:
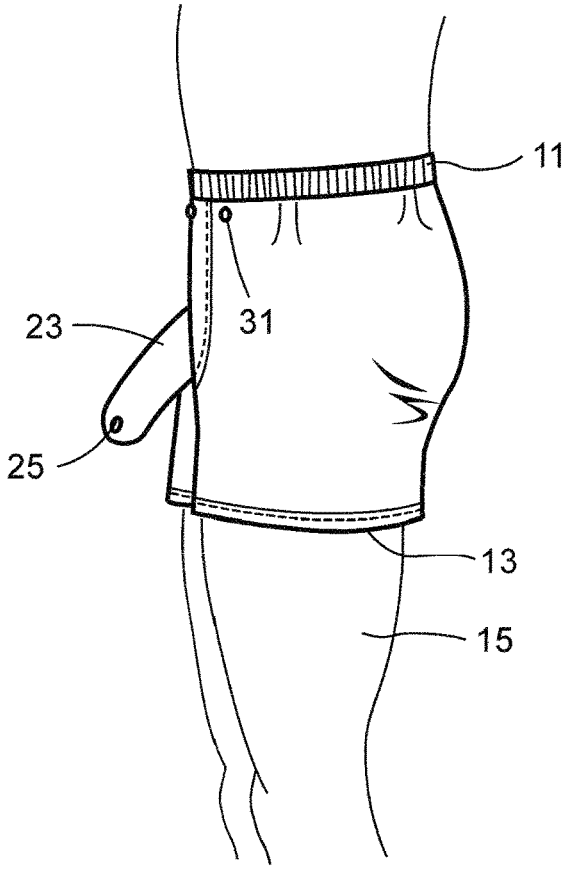
FIG. 5 is a schematic side view of the brief with the penile pouch protruding from the brief.
Figure 6:
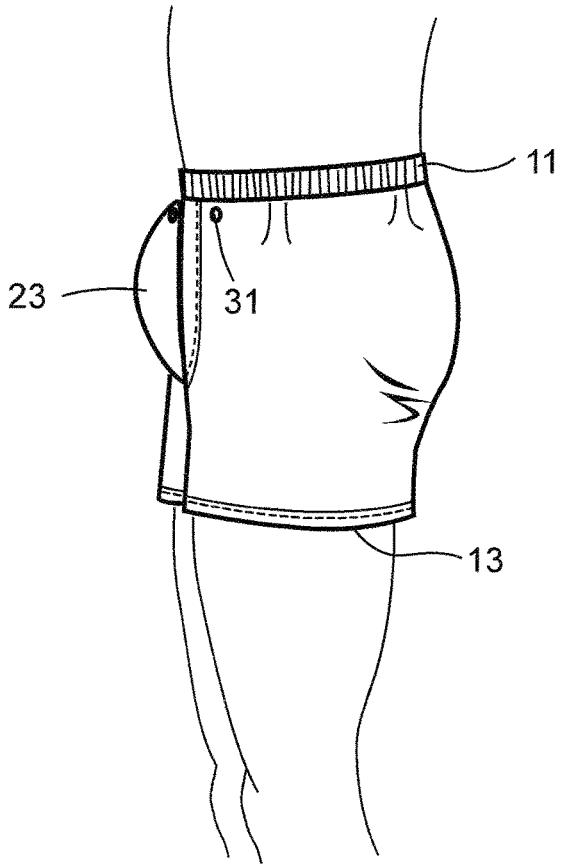
FIG. 6 is a schematic side view similar to FIG. 5 but wherein the penile pouch is secured to the middle of the brief near the waistband.

Referring to FIG. 5 which is a schematic side view of the brief worn by an exerciser, there is shown the tubular pocket 23 protruded from the middle of the brief, and FIG. 6, a schematic side view of the brief shows the tubular pocket is lifted up and fastened to the female fastener 29.

The brief described in this invention may be fabricated from the usual fabric generally used in the industry and the tubular pocket 23 may be made from the same material used in making the brief and preferably it is made from a stretchable material so as to accommodate different sizes. Also, while in the present invention male and female fasteners are used to affix the tubular pocket 23 to the brief, other fasteners such as snap in fasteners can be used to secure the tubular pocket 23 at the desired position. Thus, it can be seen that the brief described herein not only protects against impact during exercise and sports activities but it also improves the appearance as well.

The invention claimed is:

1. A man's brief consisting of:

a horizontal waistband, a left leg opening through which the left leg of said man is adapted to extend and a right leg opening through which the right leg of said man is adapted to extend, a middle section of the brief between said left leg opening and said right leg opening and an opening located in the middle section;

a penis receiving tubular pocket member having a closed upper end and a lower end with an opening configured for protrusion of the penis therethrough, said tubular pocket member opening attached to the opening in the middle section of said brief and one male fastener directly secured to the closed upper end of said tubular pocket member;

three spaced apart female fasteners affixed to the middle section of the brief between said waistband and said opening located in the middle section;

wherein said tubular pocket member is adapted to be secured in a first position by lifting said tubular pocket member upward and engaging said male fastener on said tubular pocket member to one of said female fasteners;

wherein said tubular pocket member is adapted to be secured in a second position by lifting said tubular pocket member upward and engaging said male fastener on said tubular pocket member to a second one of the female fasteners; and wherein said tubular pocket member is adapted to be secured in a third position by lifting said tubular pocket member upward and engaging said male fastener on said tubular pocket member to a third one of the female fasteners.

* * * * *